US011229282B1

(12) United States Patent
Shafer

(10) Patent No.: US 11,229,282 B1
(45) Date of Patent: Jan. 25, 2022

(54) WEARABLE CLEANING APPARATUS

(71) Applicant: Sammy J. Shafer, Casseyville, IL (US)

(72) Inventor: Sammy J. Shafer, Casseyville, IL (US)

(73) Assignee: Sammy J Shafer, Sr., Caseyville, IL (US)

( * ) Notice: Subject to any disclaimer, the term of this patent is extended or adjusted under 35 U.S.C. 154(b) by 484 days.

(21) Appl. No.: 16/047,153

(22) Filed: Jul. 27, 2018

(51) Int. Cl.

| | |
|---|---|
| ***A43B 1/10*** | (2006.01) |
| ***A43B 1/14*** | (2006.01) |
| ***A46B 9/08*** | (2006.01) |
| ***E04H 4/16*** | (2006.01) |
| ***B08B 1/00*** | (2006.01) |
| ***A63B 23/04*** | (2006.01) |

(52) U.S. Cl.
CPC ..... *A46B 9/08* (2013.01); *A43B 1/10* (2013.01); *A43B 1/14* (2013.01); *A63B 23/0405* (2013.01); *B08B 1/002* (2013.01); *E04H 4/1609* (2013.01)

(58) Field of Classification Search
CPC .... A43B 1/10; A43B 1/14; A43B 5/08; A43B 1/13; A43B 3/16; A63B 23/0405; E04H 4/1609; B08B 1/002
See application file for complete search history.

(56) References Cited

U.S. PATENT DOCUMENTS 299,691 A * 6/1884 Smith ..... A43B 3/16 36/7.3
1,136,150 A * 4/1915 McGrath ..... A47L 13/18 15/227
1,742,176 A * 12/1929 Hebig ..... A43B 5/08 36/8.1
2,075,229 A * 3/1937 Rose ..... A43B 13/223 36/62
2,571,606 A * 10/1951 Peterson ..... A47L 13/282 15/227
2,784,436 A * 3/1957 Peterson ..... A47L 13/282 15/227
3,362,775 A * 1/1968 Muecke ..... A47L 13/282 401/6
3,605,292 A * 9/1971 Goldblatt ..... A43B 3/12 36/8.1
3,676,940 A * 7/1972 Shively ..... A43B 5/08 36/8.1
3,699,672 A * 10/1972 Sims ..... A43B 3/00 36/7.7
3,748,951 A * 7/1973 Orndorff, Jr. ..... A43B 3/16 36/7.3

(Continued)

*Primary Examiner* — Katharine G Kane

(57) ABSTRACT

A wearable cleaning apparatus is disclosed. The apparatus comprises a shoe type assembly adapted to be worn on a user's foot, and a sole assembly attached to the shoe type assembly. The sole assembly is adapted to engage a ground surface, comprises at least partially raised heel portion and a scraper extending between a metatarsal portion and a toe portion of the sole assembly. The heel portion comprises a plurality of grooves, and the scraper comprises a plurality of bristles. The partially raised heel portion having a plurality of grooves is adapted to provide stability to the user while using said apparatus. The apparatus is adapted to easily move in a direction parallel to the ground surface while applying pressure with user's body weight whereby the plurality of bristles of the apparatus frictionally engage the ground surface to be cleaned.

16 Claims, 3 Drawing Sheets

(56) References Cited

U.S. PATENT DOCUMENTS 3,947,979 A * 4/1976 Sidles ..... A43B 3/16 36/32 R
3,961,428 A * 6/1976 Sidles ..... A43B 3/16 36/32 R
4,160,331 A * 7/1979 Bell ..... A43B 13/24 36/59 B
4,217,704 A * 8/1980 Whitaker ..... A43B 3/16 36/59 R
4,322,894 A * 4/1982 Dykes ..... A43B 5/08 36/114
4,434,565 A * 3/1984 Haley ..... A43C 15/06 36/59 R
4,779,360 A * 10/1988 Bible ..... A43B 3/16 36/59 R
D309,367 S * 7/1990 Bayer ..... D2/921
5,173,985 A * 12/1992 Palmer ..... A47L 13/282 15/227
5,371,958 A * 12/1994 Brosseau ..... A43B 5/08 36/11.5
5,425,186 A * 6/1995 Hoyt ..... A43B 3/16 36/4
5,473,788 A * 12/1995 Aragona ..... A47K 7/026 15/104.92
5,613,897 A * 3/1997 Thompson, Jr. ..... A47L 13/282 134/6
5,644,813 A * 7/1997 Puskas ..... A43B 3/16 15/227
5,799,418 A * 9/1998 Davis ..... A43B 5/18 36/116
6,038,726 A * 3/2000 Kelly ..... A47L 13/282 15/227
6,052,856 A * 4/2000 DeMoya ..... A47L 13/12 15/227
6,134,741 A * 10/2000 Spalione ..... A43B 3/00 15/227
6,145,156 A * 11/2000 Pullara, Jr. ..... A47L 13/18 15/227
6,393,648 B1 * 5/2002 Reynolds ..... A46B 17/02 15/160
D461,030 S * 7/2002 Cruell ..... D32/40
6,430,771 B2 * 8/2002 Ahern ..... A43B 3/00 15/118
6,446,300 B1 * 9/2002 Sleezer ..... A47L 13/282 15/227
6,948,264 B1 * 9/2005 Lyden ..... A43B 5/02 36/134
7,264,599 B1 * 9/2007 Milligan ..... A43B 3/0005 36/141
7,310,894 B1 * 12/2007 Schwarzman ..... A43B 5/08 36/3 A
D573,797 S * 7/2008 Guillaume ..... D4/119
D618,874 S * 6/2010 Hagan ..... D32/42
7,814,605 B1 * 10/2010 Tippel ..... A43B 1/009 15/114
8,032,969 B1 * 10/2011 Connelly ..... A46B 15/0055 15/160
10,022,033 B1 * 7/2018 Maynard ..... A43B 3/0036
2002/0088140 A1 * 7/2002 Wang ..... F16B 39/34 36/3 B
2002/0184791 A1 * 12/2002 Ko ..... A43B 3/105 36/8.1
2003/0106240 A1 * 6/2003 Wang ..... A43B 7/146 36/3 B
2006/0265828 A1 * 11/2006 Mallatt ..... A46B 5/04 15/227
2008/0301974 A1 * 12/2008 Bowen ..... A43B 3/18 36/7.6
2010/0088928 A1 * 4/2010 Sarantakos ..... A43C 11/1493 36/103
2010/0242199 A1 * 9/2010 Hogan ..... A43B 3/108 15/227
2017/0238655 A1 * 8/2017 Pineda ..... A43B 5/08
2018/0303193 A1 * 10/2018 Weaver ..... A43B 13/22

* cited by examiner

WEARABLE CLEANING APPARATUS

BACKGROUND OF THE INVENTION

1. Field of the Invention

The present disclosure relates to a cleaning apparatus. More particularly, the present disclosure relates to a wearable cleaning apparatus adapted to be worn on a user's foot for scrubbing or cleaning a floor surface or the like.

2. Description of the Related Art

Hard floor surfaces in commercial establishments including restaurants, commercial kitchens, hospitals, laboratories and retail stores are constructed from materials such as linoleum or ceramic tile, vinyl floor covering materials, wood, and the like. Such hard floor surfaces accommodate relatively high foot traffic with minimal visible wear, and further are conducive to periodic cleaning using water-based detergents.

To clean this configuration of floor surfaces, the ground-in dirt, grease and particles stuck to or accumulated within the porous surface must be periodically removed by manual scrubbing using a scrub brushes. These hand-operated scrub brushes undesirably require a user or a cleaning worker to crawl on the floor with their hands and knees, and exert considerable muscular effort with the arms and back. In household cleaning environment, such manual scrubbing of a floor surface constitutes a laborious task, which may hurt the user's limbs or even other body parts.

Several devices have been designed in the past. None of them, however, included a cleaning apparatus that is capable of addressing the foregoing discussed issues.

Applicant believes that a related reference corresponds to U.S. Pat. No. 5,173,985 filed by Nancy K. Palmer for foot mounted scrubber device. The Nancy reference teaches a scrubber device for use in scrubbing and cleaning selected problem areas of a hard floor surface, and for cleaning difficult to reach baseboard surfaces and corners along the edge of a floor. However, the Nancy designed to secure on conventional shoes with clips and straps, which may tend to roll, or dis-orient upon user's brushing motion.

Another related reference is U.S. Pat. No. 6,052,856 filed by Laura M. DeMoya et al for foot worn mop system. The Laura reference teaches a mop assembly that is attachable to the user's foot. The mop assembly is constructed to be worn over the foot or the shoe of the user, which includes a number of absorbent inserts that can absorb fluid from the floor contact sponge. A number of detachable scrubbing pads are included that are attachable to the mop assembly. However, the Laura reference does not provided any provision for stability or balance while making brushing motion with the user's foot to scrub the floor. Hence, this mop system may tend to cause slipperiness, which leads to safety hazard to the user.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide a wearable cleaning apparatus for scraping or cleaning dirt, and the like.

It is another object of the present invention to provide a wearable cleaning apparatus adapted to be secured to foot in position, enabling a user to scrape or clean dirt, and the like.

It is yet another object of the present invention to provide a wearable cleaning apparatus comprising a shoe type assembly adapted to be worn on foot of the user.

It is yet another object of the present invention to provide a wearable cleaning apparatus comprising a sole assembly attached to the shoe, configured to engage on a ground surface.

It is yet another object of the present invention to provide a wearable cleaning apparatus comprising the sole assembly having at least partially raised heel portion with a plurality of grooves to provide stability.

It is yet another object of the present invention to provide a wearable cleaning apparatus comprising a scraper having a plurality of bristles extending between a metatarsal portion and a toe portion of the sole assembly to engage the surface to be cleaned.

It is yet another object of the present invention to provide a wearable cleaning apparatus adapted to easily move in a direction parallel to the ground surface while applying pressure with user's body weight whereby the plurality of bristles of the apparatus frictionally engages the ground surface to be cleaned.

It is yet another object of the invention to provide a wearable cleaning apparatus made of material having elasticity property to provide a frictional fit on securing the apparatus to the foot of the user.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
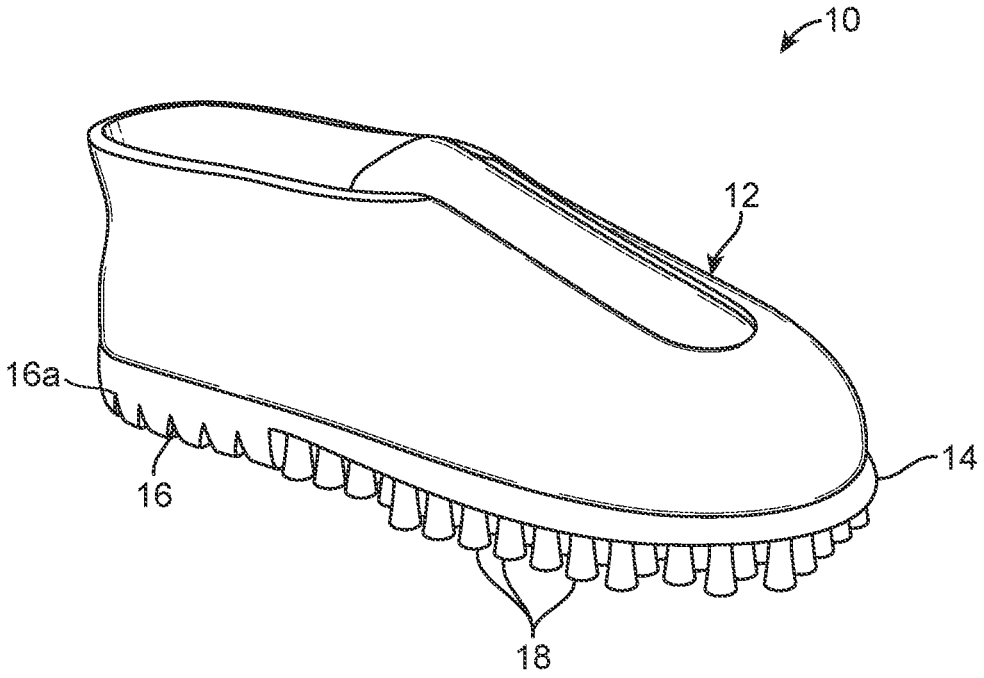
FIG. 1 exemplarily illustrates a perspective view of a wearable cleaning apparatus 10 in an embodiment of the present invention. A shoe type assembly 12 adapted to be worn on user's foot and a sole assembly 14 attached to the shoe type assembly 12 comprising a plurality of grooves 16 and a scraper having a plurality of bristles 18 is illustrated.
Figure 2A:
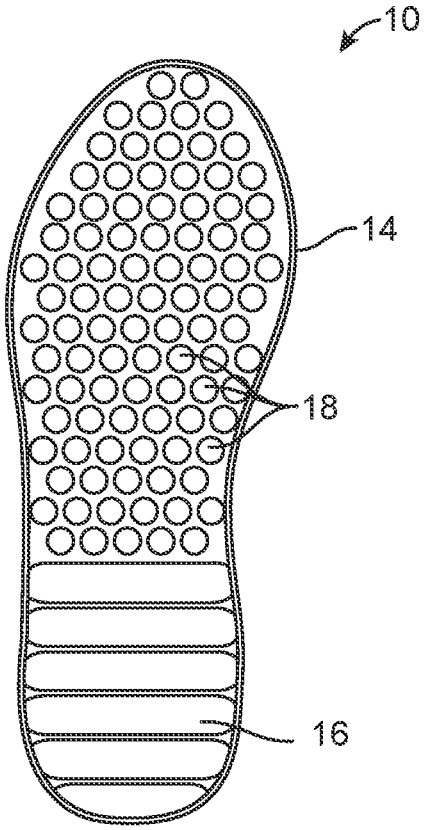
FIG. 2A exemplarily illustrates a bottom/rear view of the wearable cleaning apparatus 10 in an embodiment of the present invention. Sole assembly 14 comprising plurality of grooves 16 disposed at heel portion, and the plurality of bristles 18 disposed between metatarsal portion and toe portion is illustrated.
Figure 2B:
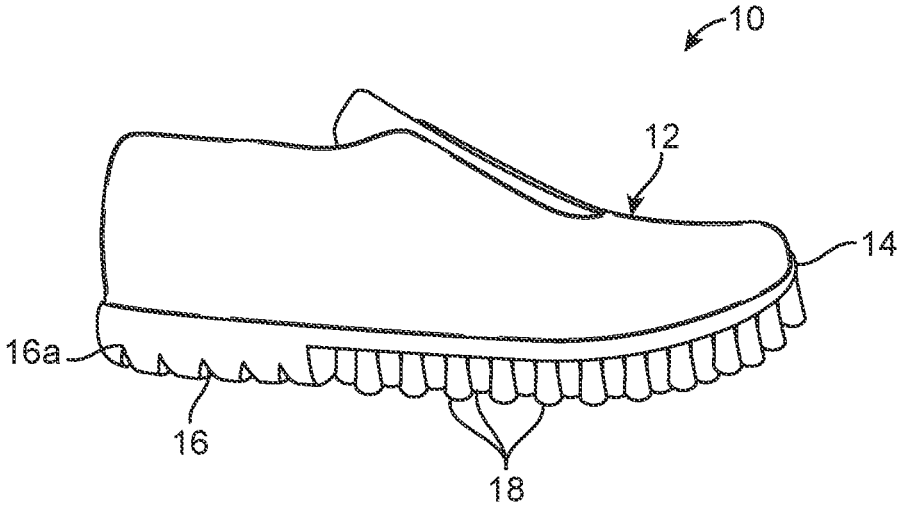
FIG. 2B exemplarily illustrates a side view of the wearable cleaning apparatus 10 in an embodiment of the present invention. Scraper comprising plurality of bristles 18 and the heel portion comprising the plurality of grooves 16 is illustrated.
Figure 3A:
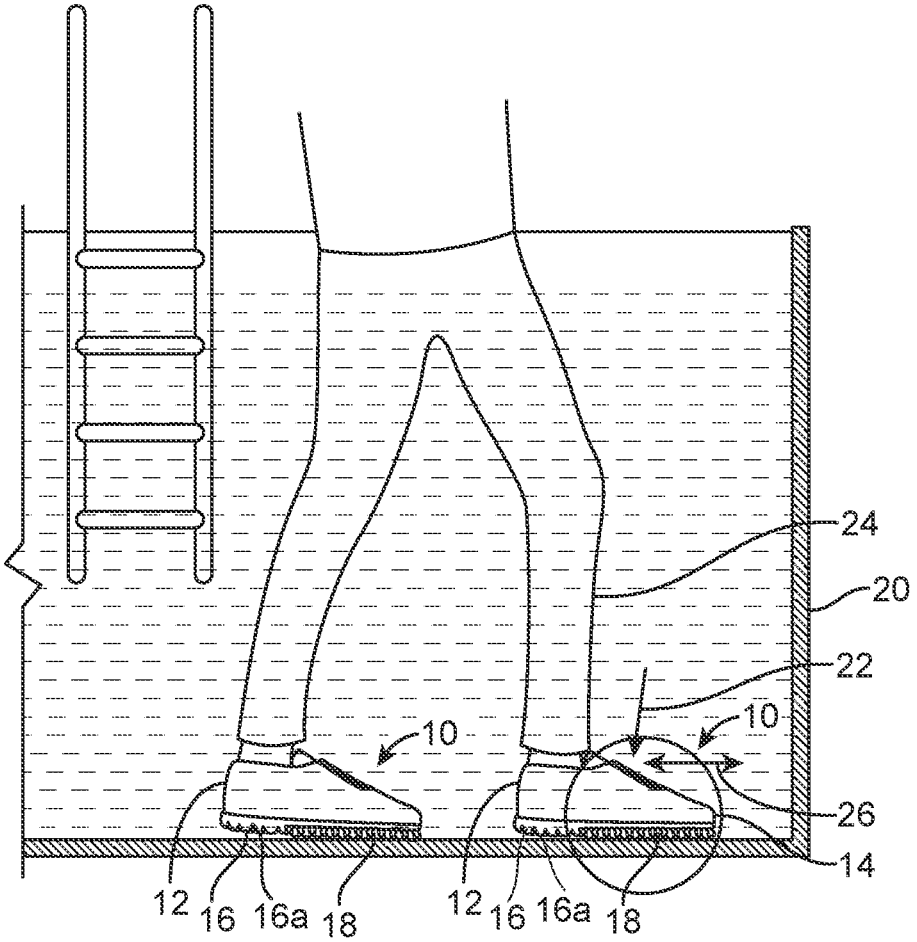
FIG. 3A exemplarily illustrates the wearable cleaning apparatus 10 worn by a user 24 in an environment, such as a pool 20, in an embodiment of the present invention. Apparatus 10 is adapted to move in a direction parallel to the ground surface on applying pressure by the user 24 enabling the plurality of bristles 18 to frictionally engage the ground surface is illustrated.
Figure 3B:
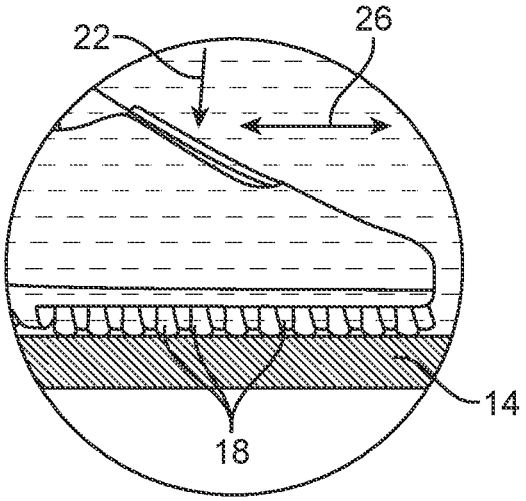
FIG. 3B exemplarily illustrates a zoom view of the plurality of bristles 18 on scrubbing operation in an embodiment of the present invention. The plurality of bristles 18 frictionally engaging the ground surface to be cleaned is illustrated.

Referring now to the drawings, FIGS. 1-3B, where the present invention is generally referred with numeral 10, it can be observed that a wearable cleaning apparatus 10 for cleaning, scrapping or polishing a floor surface, in accordance with one embodiment, is provided. The wearable cleaning apparatus 10 is simple in construction, inexpensive, and stay properly positioned on foot of the user 24 during use.

The apparatus 10 comprises a sole assembly 14, which has an exposed underface for engaging the floor surface to provide the desired scouring or polishing. A shoe type assembly 12 is secured to opposite side edge of the sole assembly 14 to cooperate with it. The shoe type assembly 12 is configured to provide a receptacle for reception of foot of the user 24. The sole assembly 14 comprises at least partially raised heel portion and an integral scraper. The integral scraper configured to extend between a metatarsal portion and a toe portion of the sole assembly 14 to engage the surface to be cleaned. The heel portion is configured to extend around the heel of the user 24 to maintain the apparatus 10 in position on the user's foot. The heel portion comprises a plurality of grooves 16 to provide stability during use of the apparatus 10. The plurality of grooves 16 may be interconnected to one another along said sole assembly 14. The plurality of grooves 16 may be interconnected to each other along a top portion 16*a*. The shoe type assembly 12 may extend an entire length of the sole assembly 14. The shoe type assembly 12 may include a rounded front end. The shoe type assembly 12 may include a tongue cutout extending a partial length of the shoe type assembly 12. The shoe type assembly 12 may include a shoe tongue within the tongue cutout. The shoe tongue may be longer than the tongue cutout.

In some embodiments, a plurality of bristles 18 is disposed at the scraper. In another embodiment, the plurality of bristles 18 is disposed at any portion of the sole assembly 14, for example, front edge of the sole assembly 14. In another embodiment, the heel portion could employ any other suitable configuration to provide stability while using the apparatus 10. In one embodiment, the shoe type assembly 12 is moisture proof. In one embodiment, each groove 16 is ¼ inches in deep, and each bristle 18 is ½ inches in width. The plurality of bristles 18 may be parallel to each other along a top portion thereof. The plurality of bristles 18 may be parallel to each other and of a same height. The plurality of bristles 18 may be arranged in rows at an underside of the sole assembly 14. The plurality of bristles 18 may include rounded distal ends. The plurality of grooves 16 may extend from the end of the plurality of bristles 18 to the heel portion. The plurality of grooves 16 and the plurality of bristles 18 may contact to a ground surface simultaneously.

In one embodiment, the bristles 18 could be made of any material that has a density appropriate for scrubbing action. As used herein, bristles 18 are intended to cover alternate cleaning materials, such as scouring pad material, steel wool, and so forth. Examples of potential materials include, but are not limited to, polymers, plastic, wire, polyethylene terephthalate, nylon, tampico, bassine, or poled polymers. It is understood that there are continuous advances in the area of bristle and polymer technology and any future materials that have density and other features appropriate for scrubbing action are considered within the scope of this invention.

In one embodiment, the bristles 18 are provided in any appropriate length. The present invention allows a greater flexibility in length and stiffness of the bristles 18. In one embodiment, the bristles 18 are preferably short and stiff to achieve strong scrubbing action. In some embodiments, the bristles 18 are preferably long and soft to achieve buffing-type action.

In some embodiments, the shoe type assembly 12 could be a sock-like member, slipper, or flip-flop that could be worn by the user 24. In some embodiments, the shoe type assembly 12 configured with a characteristic shape that could be worn on the user's foot. Further, the apparatus 10 could be manufactured in any customized shape, size, or in any distinctive colors. In one embodiment, the apparatus 10 is made of rubber material. In another embodiment, the apparatus 10 is made of material selected from neoprene, mesh, rubber, plastic, Tri-Permalon™, latex, a combination thereof, or any other material that is durable enough to withstand back-and-forth cleaning movement and water resistant. Further, the material comprises sufficient flexibility that it would not wear on the user's heel or toes, causing chaffing during use. In some embodiments, the apparatus 10 comprises an inner cushion (not shown) that facilitate user's comfort.

During cleaning operation, the user 24 could secure the apparatus 10 of the present invention to either one or both of his feet before beginning a cleaning operation. The user 24 of the apparatus 10 need to simply brush his foot back and forth over the dirt spot to cause the bristle surface of the sole assembly 14 to remove the dirt. Further, the tight engagement of the shoe type assembly 12 on the foot of the user 24 minimizes slippage even when the user 24 reciprocally maneuver his foot on the spot being cleaned. The cleaning apparatus 10 is moved in a direction parallel, represented by arrow 26, to the ground surface while applying pressure, represented by arrow 22, with user's body weight, whereby the plurality of bristles 18 of the apparatus 10 frictionally engage the ground surface to be cleaned. It should also be noted that the bristles 18 could simply be washed out or rinsed between uses as desired.

The apparatus 10 according to some embodiments of the invention are particularly useful in cleaning tile floors, shower stalls, bathtubs, boat bottoms, pool bottoms, coolers, and the like. In addition to the cleaning benefits described, apparatus 10 also encourages the user 24 for performing an exercise to their legs. The back and forth motion of the leg to clean the floor works a major muscle group, and the user 24 could put on music and enjoy cleaning for once while obtaining health benefits.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A wearable cleaning apparatus, comprising:

a shoe type assembly adapted to be worn on a foot of a user; and a sole assembly attached to the shoe type assembly configured to engage a ground surface, said shoe type assembly extending an entire length of said sole assembly, said sole assembly including an at least partially raised heel portion having a plurality of grooves adapted to provide stability, and a scraper including a plurality of bristles extending between a metatarsal portion and a toe portion of the sole assembly to engage the surface to be cleaned, said plurality of grooves being located adjacent to said plurality of bristles at a rear of said sole assembly, said plurality of grooves extending entirely across a width of said sole assembly, said plurality of grooves being interconnected to one another along said sole assembly, said plurality of grooves being interconnected to each other along a top portion thereof, a spacing defined between each of said plurality of grooves, said plurality of bristles being parallel to each other and of a same height, said plurality of bristles extending along at least half a length of said sole assembly and said plurality of grooves extending from the end of the plurality of bristles to the heel portion, said plurality of grooves and said plurality of bristles making contact said ground surface simultaneously.

2. The apparatus of claim 1, wherein the apparatus is adapted to move in a direction parallel to the ground surface on applying pressure with user's body weight to the plurality of bristles to frictionally engage the ground surface to clean.

3. The apparatus of claim 1, wherein the shoe type assembly is moisture proof.

4. The apparatus of claim 1, wherein each groove is ¼ inches in deep.

5. The apparatus of claim 1, wherein each bristle is ½ inches in width.

6. The apparatus of claim 1, wherein the shoe type member is made of material having elasticity property to provide a frictional fit on securing the apparatus to the foot of the user.

7. The apparatus of claim 1, is made of rubber material.

8. The apparatus of claim 1, wherein the shoe type assembly is at least one of a sock-like member, a slipper, or a flip-flop.

9. The apparatus of claim 1, wherein each bristle is made of at least one of a polymer, a plastic, a polyethylene terephthalate or a nylon material.

10. The apparatus of claim 1, wherein each bristle is configured to provide optimal cleaning operation.

11. The apparatus of claim 1, wherein said plurality of bristles are arranged in rows at an underside of said sole assembly, some of said rows including a different number of said plurality of bristles.

12. The apparatus of claim 1, wherein said plurality of bristles are stiff to permit scrubbing.

13. The apparatus of claim 1, wherein said plurality of bristles are soft to permit buffing.

14. The apparatus of claim 1, wherein said plurality of bristles include rounded distal ends.

15. The apparatus of claim 1, wherein said shoe type assembly includes a rounded front end, said shoe type assembly including a tongue cutout extending a partial length of said shoe type assembly, said shoe type assembly including a shoe tongue within said tongue cutout, said shoe tongue being longer than said tongue cutout.

16. A wearable cleaning apparatus, consisting of:

a shoe type assembly adapted to be worn on a foot of a user; and a sole assembly attached to the shoe type assembly configured to engage a ground surface, said shoe type assembly extending an entire length of said sole assembly, said sole assembly including an at least partially raised heel portion having a plurality of grooves adapted to provide stability, and a scraper including a plurality of bristles extending between a metatarsal portion and a toe portion of the sole assembly to engage the surface to be cleaned, said plurality of grooves being located adjacent to said plurality of bristles at a rear of said sole assembly, said plurality of grooves extending entirely across a width of said sole assembly, said plurality of grooves being interconnected to one another along said sole assembly, said plurality of grooves being interconnected to each other along a top portion thereof, a spacing defined between each of said plurality of grooves, said plurality of bristles being parallel to each other, said plurality of bristles extending along at least half a length of said sole assembly and said plurality of grooves extending from the end of the plurality of bristles to the heel portion, said plurality of bristles arranged in rows at an underside of said sole assembly, said rows including a different number of said plurality of bristles, said plurality of bristles and said plurality of grooves being in simultaneous contact with the ground surface.

* * * * *